US009286863B2

(12) United States Patent
Moon

(10) Patent No.: US 9,286,863 B2
(45) Date of Patent: Mar. 15, 2016

(54) APPARATUS AND METHOD FOR A CELESTE IN AN ELECTRONICALLY-ORBITED SPEAKER

(71) Applicant: Nancy Diane Moon, Del Mar, CA (US)

(72) Inventor: Nancy Diane Moon, Del Mar, CA (US)

( * ) Notice: Subject to any disclaimer, the term of this patent is extended or adjusted under 35 U.S.C. 154(b) by 271 days.

(21) Appl. No.: 14/024,644

(22) Filed: Sep. 12, 2013

(65) Prior Publication Data

US 2015/0071451 A1 Mar. 12, 2015

(51) Int. Cl.

| | |
|---|---|
| ***G10B 1/04*** | (2006.01) |
| ***H04R 5/02*** | (2006.01) |
| ***H04S 7/00*** | (2006.01) |
| ***H04R 3/04*** | (2006.01) |
| *H04R 1/24* | (2006.01) |
| *H04R 1/30* | (2006.01) |
| *H04R 1/34* | (2006.01) |
| *G10B 3/18* | (2006.01) |

(52) U.S. Cl.

CPC .. *G10B 1/04* (2013.01); *H04R 3/04* (2013.01); *H04R 5/02* (2013.01); *H04S 7/305* (2013.01); *G10B 3/18* (2013.01); *H04R 1/24* (2013.01); *H04R 1/30* (2013.01); *H04R 1/345* (2013.01); *H04R 2430/03* (2013.01); *H04S 2420/07* (2013.01)

(58) Field of Classification Search

CPC ..... G10B 1/04; H04R 1/30; H04R 5/02; H04R 1/345; H04R 2430/03; H04S 7/305

USPC ..... 381/62, 120, 119; 84/708, 631, 664

See application file for complete search history.

(56) References Cited

U.S. PATENT DOCUMENTS

| | | | | | |
|---|---|---|---|---|---|
| 3,535,431 | A * | 10/1970 | Szabo | 84/695 | |
| 3,644,657 | A * | 2/1972 | Miller | G10H 1/04 | 84/705 |
| 3,749,837 | A * | 7/1973 | Doughty | 381/62 | |
| 3,809,792 | A * | 5/1974 | Deutsch | 84/631 | |
| 4,000,676 | A * | 1/1977 | Love | 84/706 | |
| 4,072,079 | A * | 2/1978 | Sharp | 84/706 | |
| 4,162,372 | A * | 7/1979 | Gross | 381/62 | |
| 4,280,388 | A * | 7/1981 | White | 84/708 | |
| 4,308,422 | A * | 12/1981 | Schmoll, III | 381/62 | |
| 4,308,428 | A * | 12/1981 | Finch | 381/62 | |
| 4,329,902 | A * | 5/1982 | Love | G10H 1/043 | 381/100 |
| 4,342,247 | A * | 8/1982 | Ippolito et al. | 84/664 | |
| 4,392,405 | A * | 7/1983 | Franz et al. | 84/603 | |
| 4,428,270 | A * | 1/1984 | Ippolito | 84/706 | |
| 4,622,878 | A * | 11/1986 | Sharp | 84/626 | |
| 5,763,807 | A * | 6/1998 | Clynes | 84/705 | |
| 5,848,166 | A * | 12/1998 | Fisher et al. | 381/62 | |
| 5,998,722 | A * | 12/1999 | Kondo | 84/622 | |
| 6,873,708 | B1 * | 3/2005 | Levy | 381/98 | |
| 6,931,134 | B1 * | 8/2005 | Waller, Jr. | G10H 1/0091 | 381/119 |
| 2013/0163787 | A1 * | 6/2013 | Moon | 381/120 | |
| 2015/0078584 | A1 * | 3/2015 | Moon | G10H 1/46 | 381/104 |

* cited by examiner

*Primary Examiner* — John Villecco

(57) ABSTRACT

Exemplary embodiments are directed to a sound modification system and loud speaker system. The system may impose amplitude, frequency and delay modulation on a signal representing the output of an musical instrument or other sound source while also imposing a sense of movement of the sound to the listener and a periodic variation of the harmonic content of the sound. Further, the system may simultaneously amplify sound signals without the amplitude, frequency, delay and spatial sense of modulation or a different sense of modulation. The system combines a plurality of sound transducers, a plurality of amplifiers and signal processors to provide a flexible, portable and practical sound modification and amplification system.

15 Claims, 12 Drawing Sheets

Electronic Celeste

Celeste in an Electronically Orbited Speaker Figures
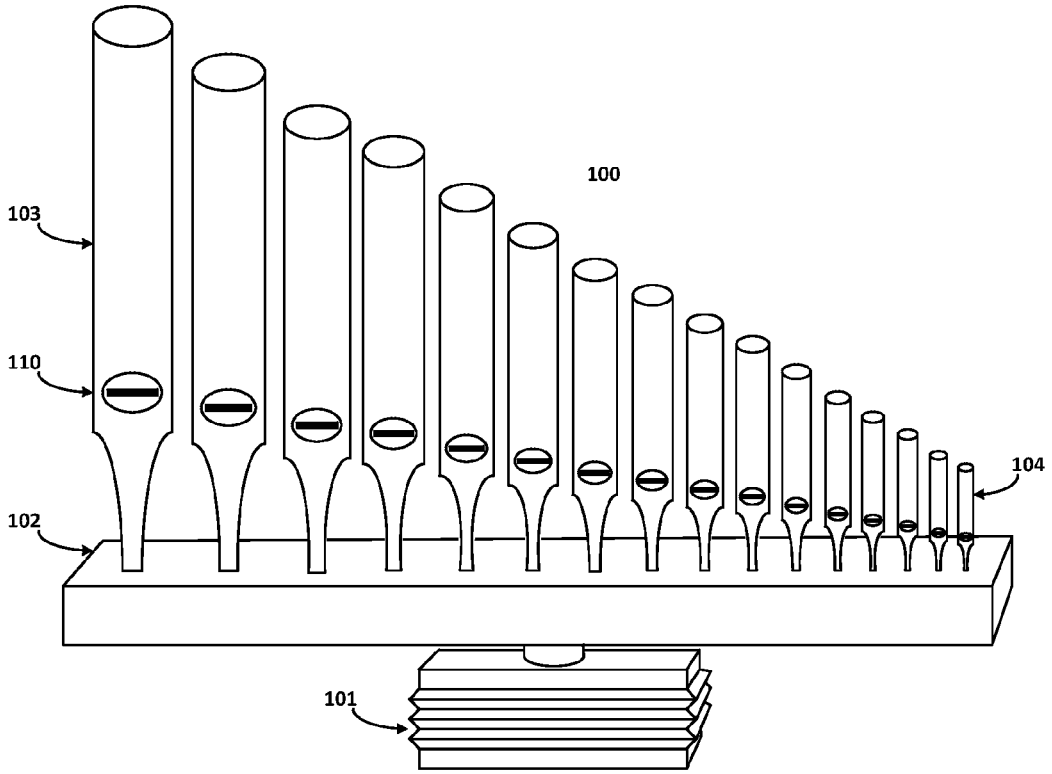
Figure 1 – PRIOR ART - Wind-Driven Pipe Organ Rank with Tremulant
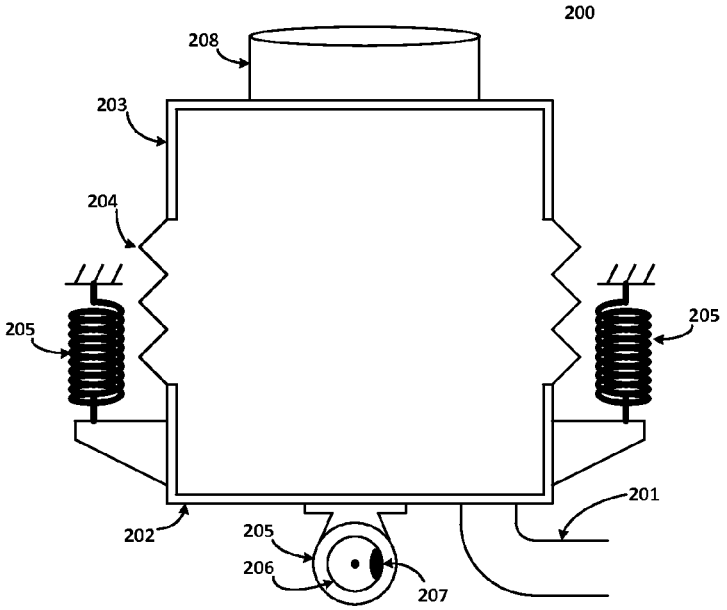
Figure 2 – PRIOR ART - Pipe Organ Tremulant Cross Section

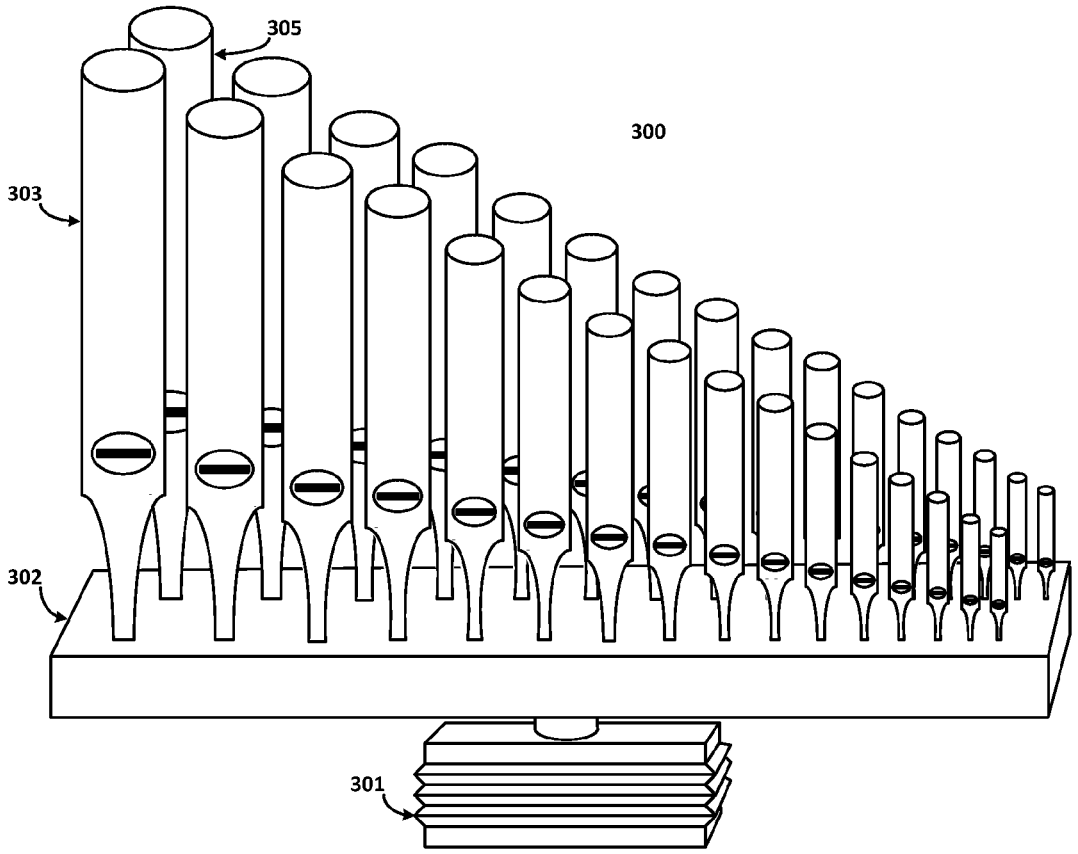
Figure 3 – PRIOR ART - Pipe Organ Rank with Celeste
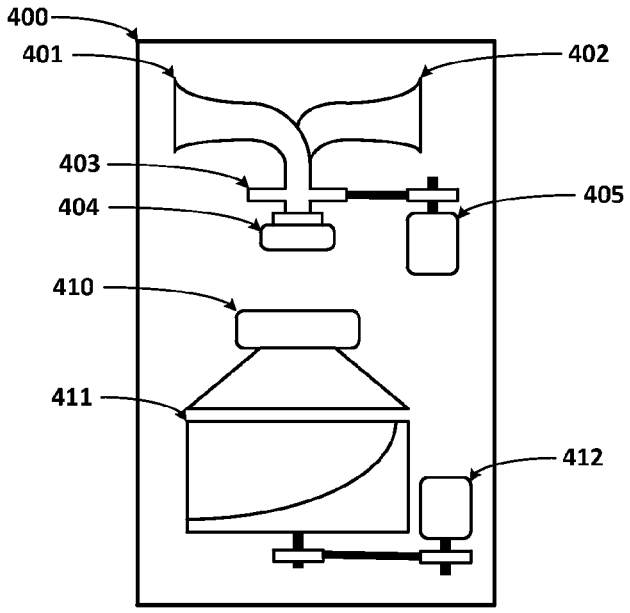
Figure 4 – PRIOR ART - Mechanically Orbited Speaker Internal View

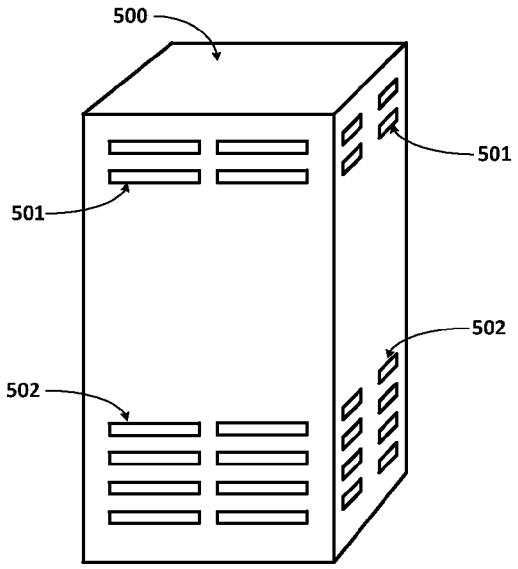
Figure 5 – PRIOR ART - Mechanically Orbited Speaker Enclosure External View
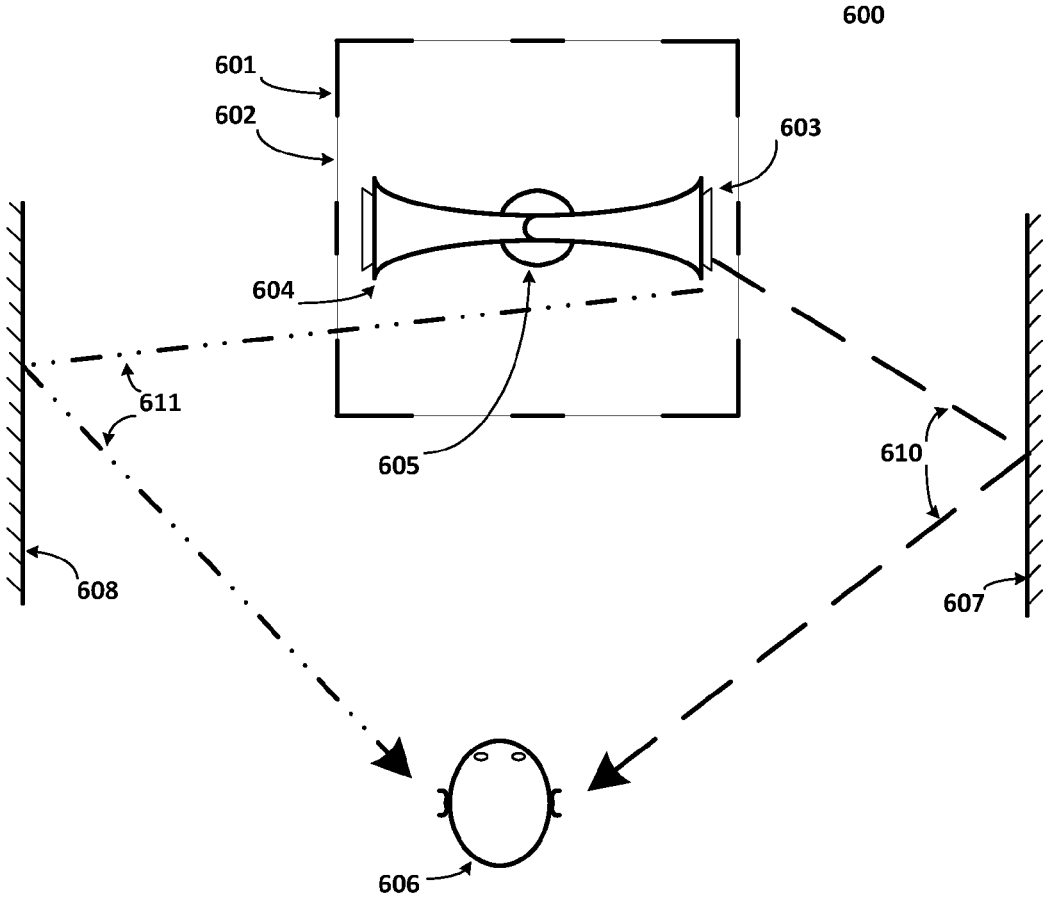
Figure 6 – PRIOR ART - Mechanically Orbited Speaker Sound Paths

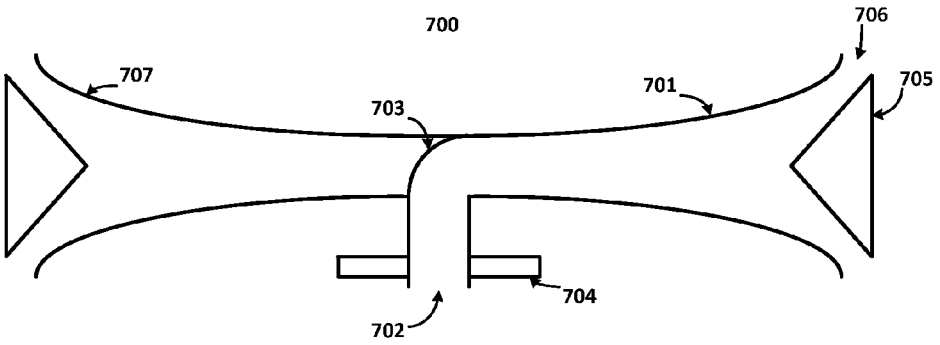
Figure 7 – PRIOR ART - Cross Section of Horn
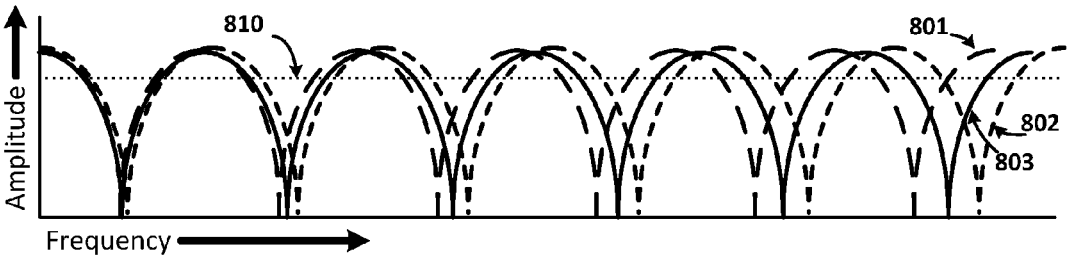
Figure 8 – Comb Filter
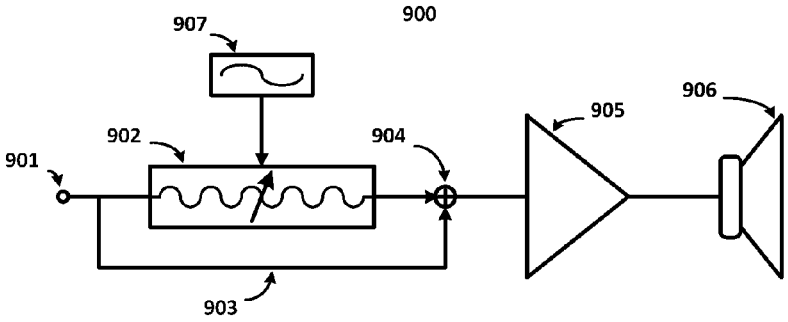
Figure 9 – PRIOR ART - Electronic Flanger

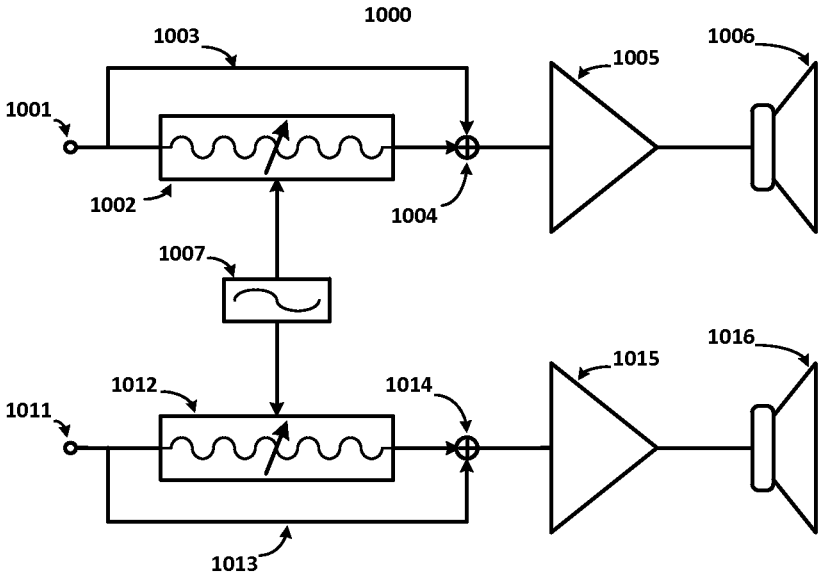
Figure 10 – PRIOR ART - Stereo Flanger
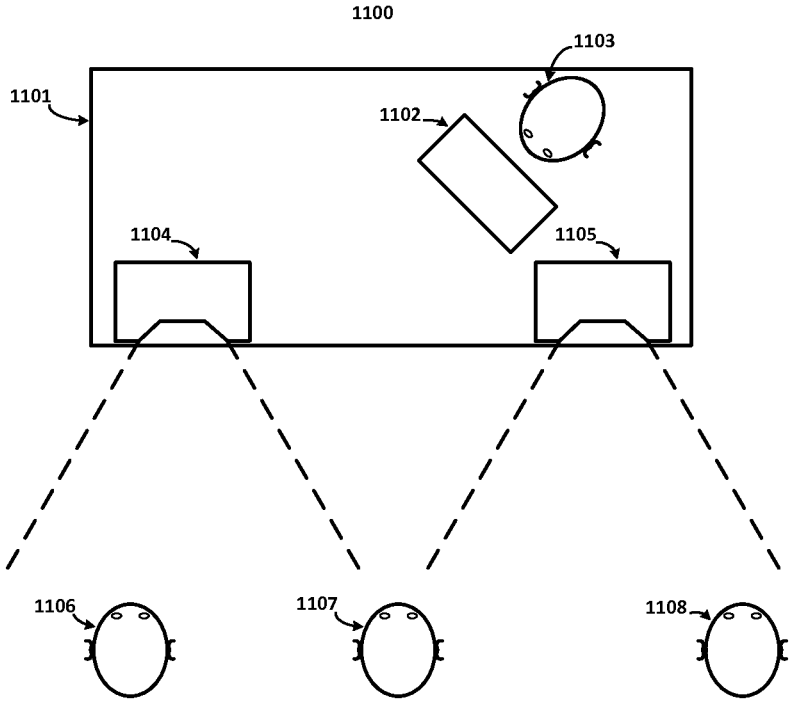
Figure 11 – PRIOR ART - Stereo Sweet Spot

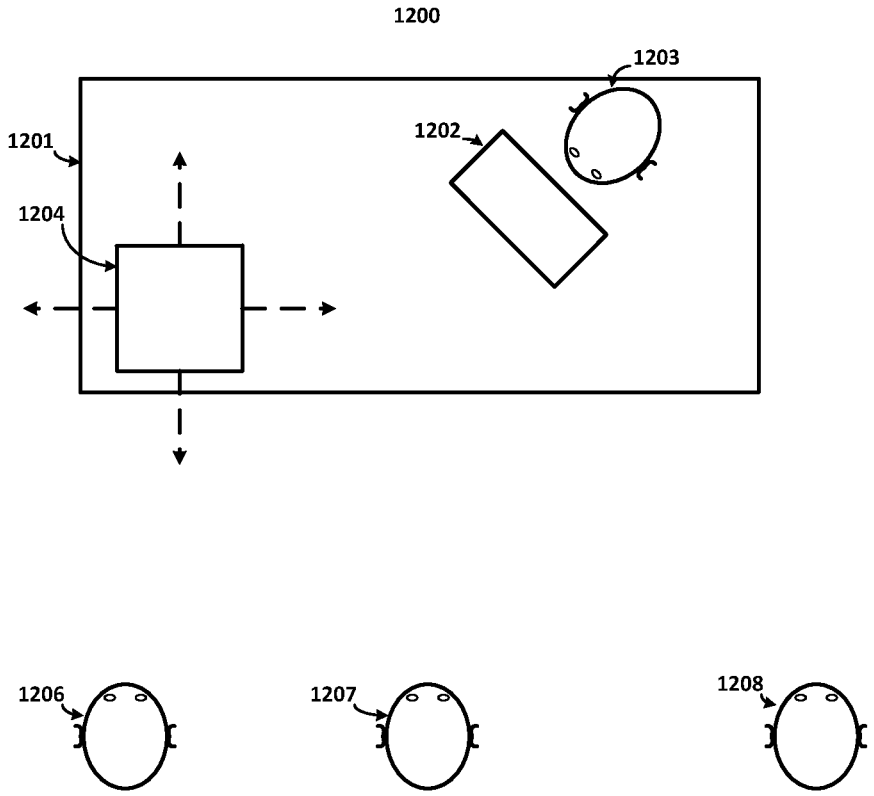
Figure 12 – Full Coverage Effect
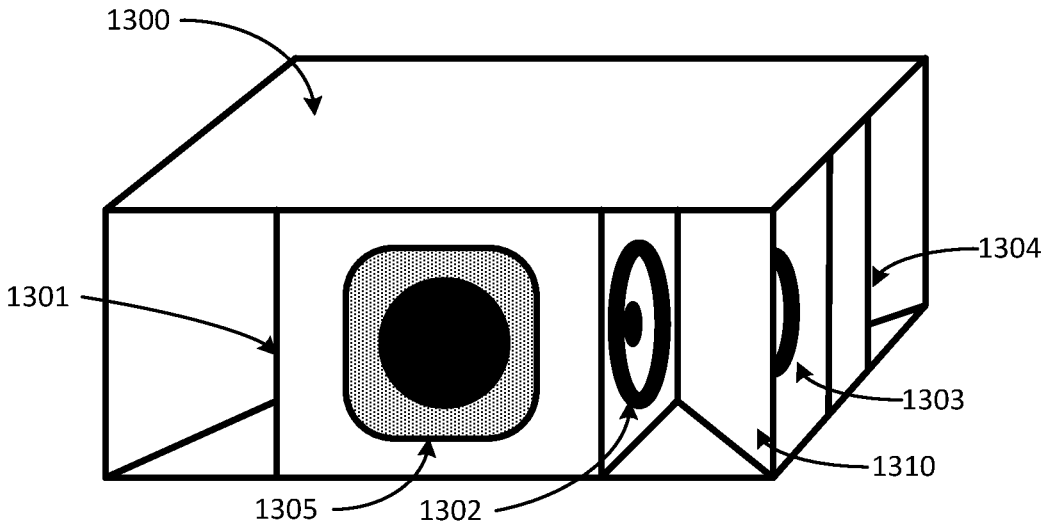
Figure 13 – Electronically Orbited Speaker Enclosure

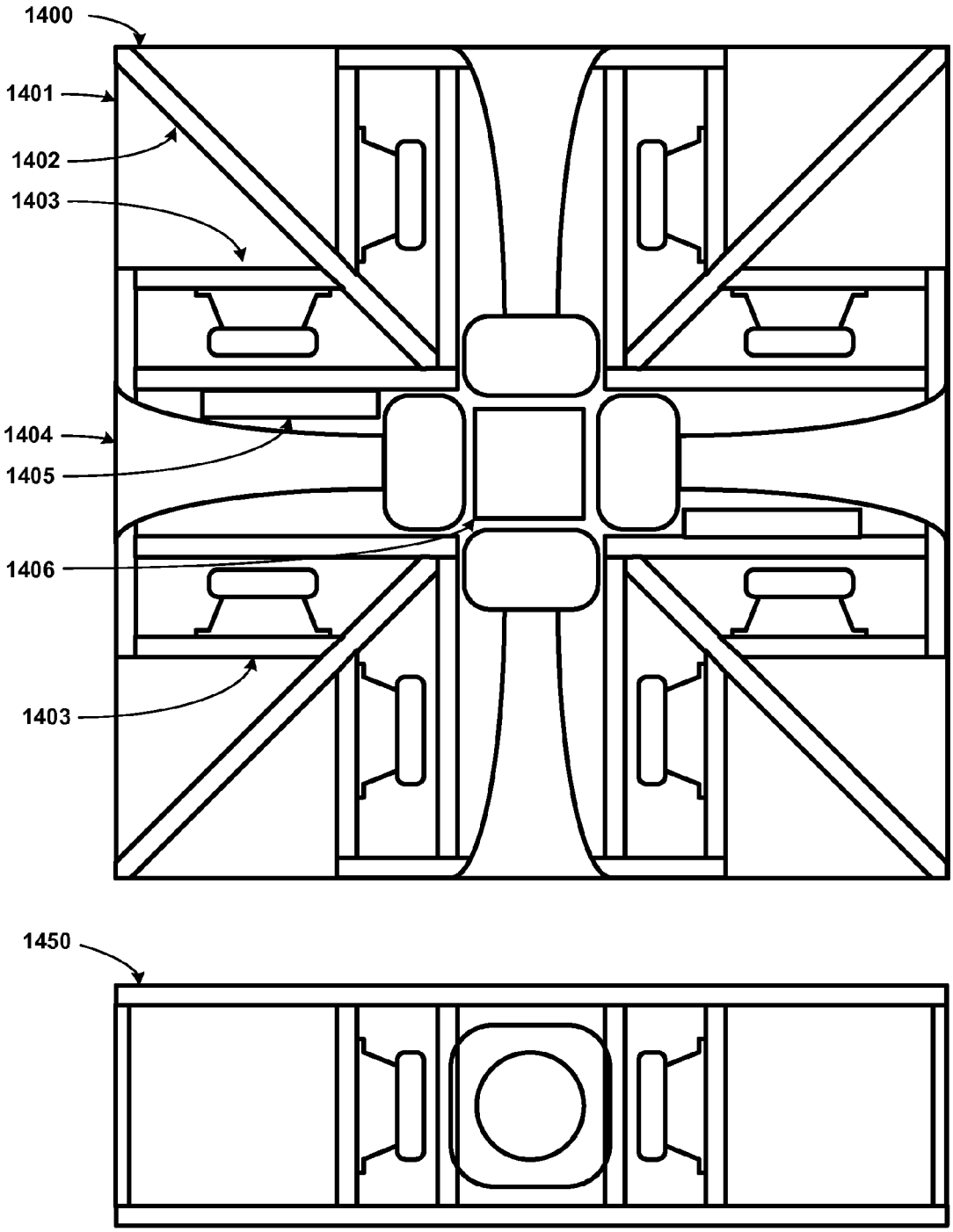
Figure 14 – Speaker Enclosure 2D Drawing

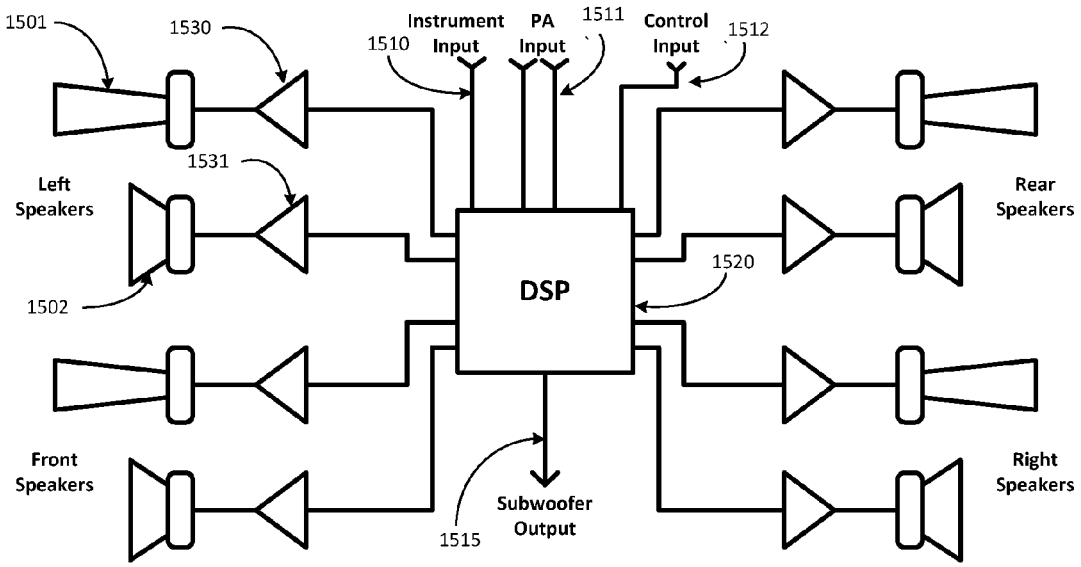
Figure 15 – Electronically Orbited Speaker Block Diagram
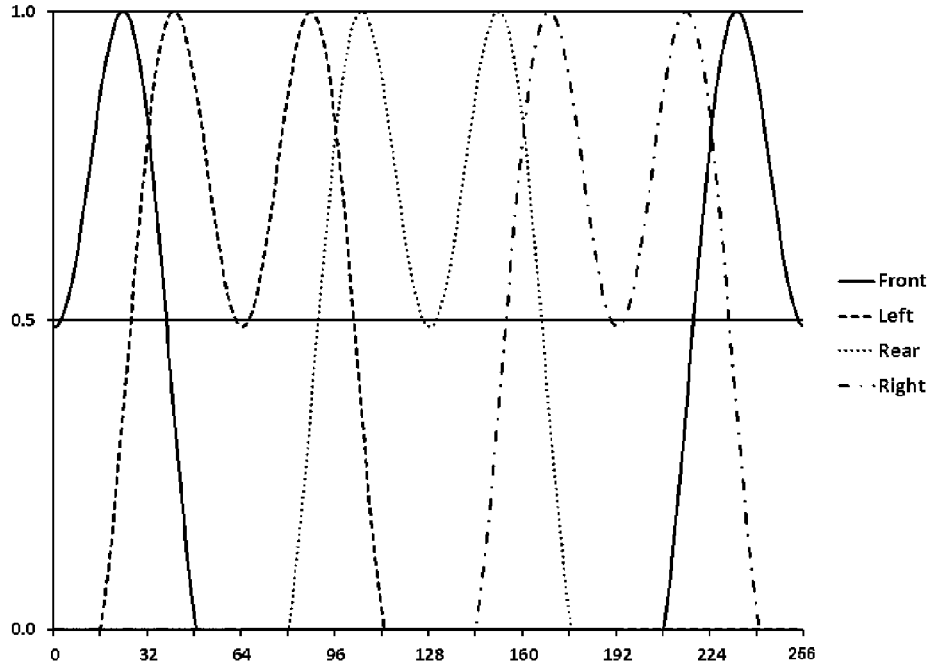
Figure 16 – Amplitude Envelope for Electronic Orbiting

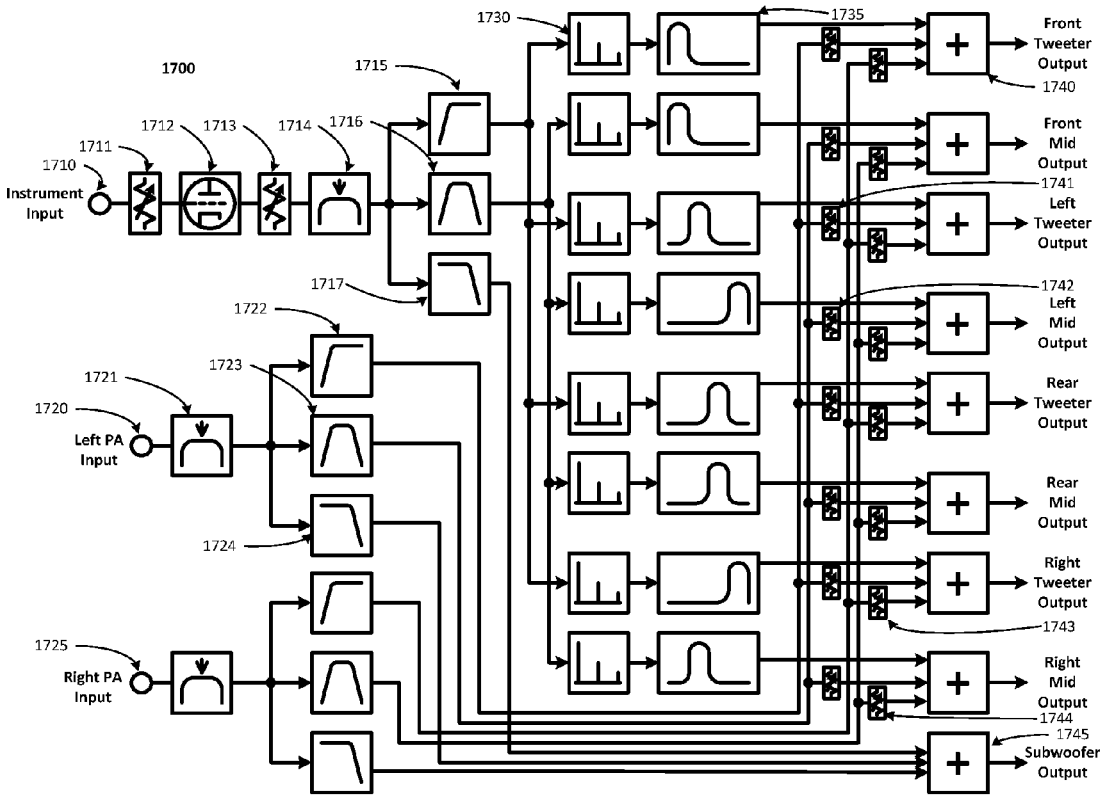
Figure 17 – DSP Signal Flow with Per-Path Reverberation and Vacuum Tube Preamplifier

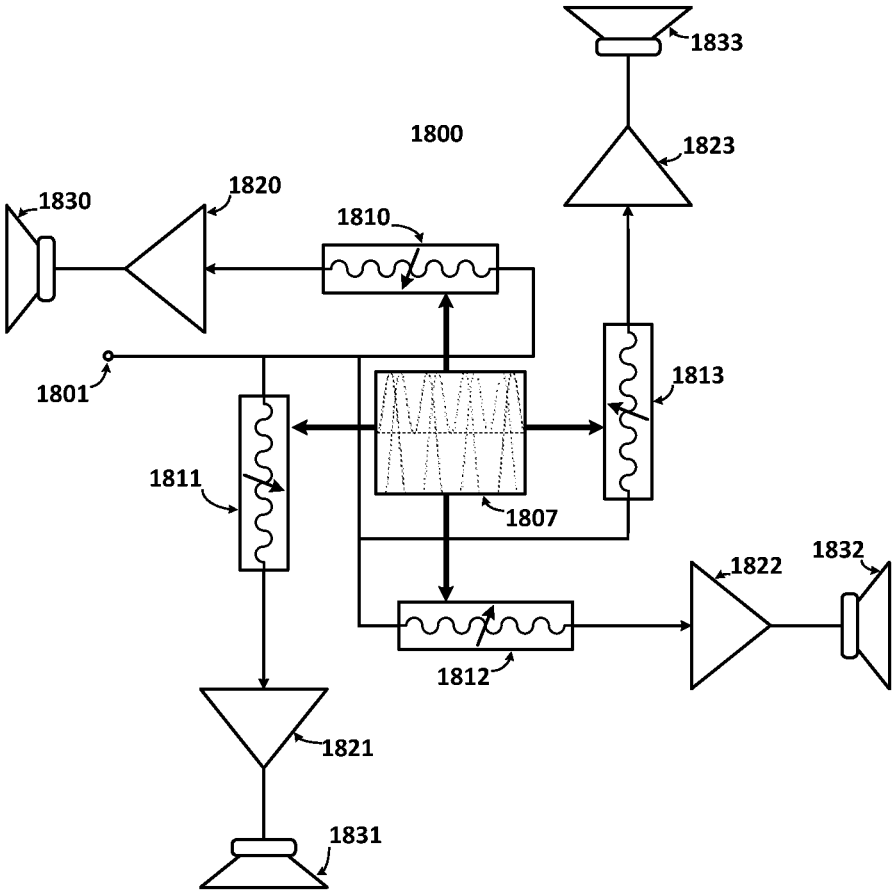
Figure 18 – Electronic Celeste

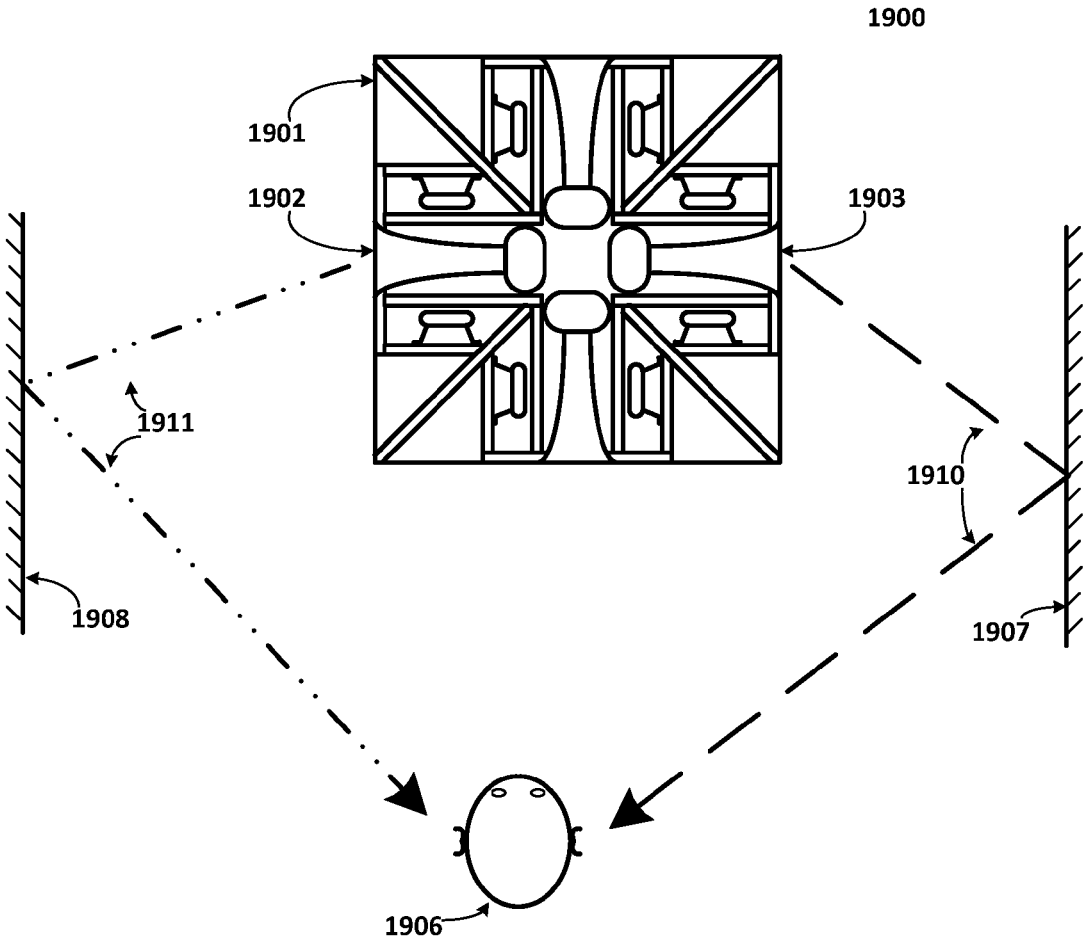
Figure 19 – Electronic Celeste Sounds Paths

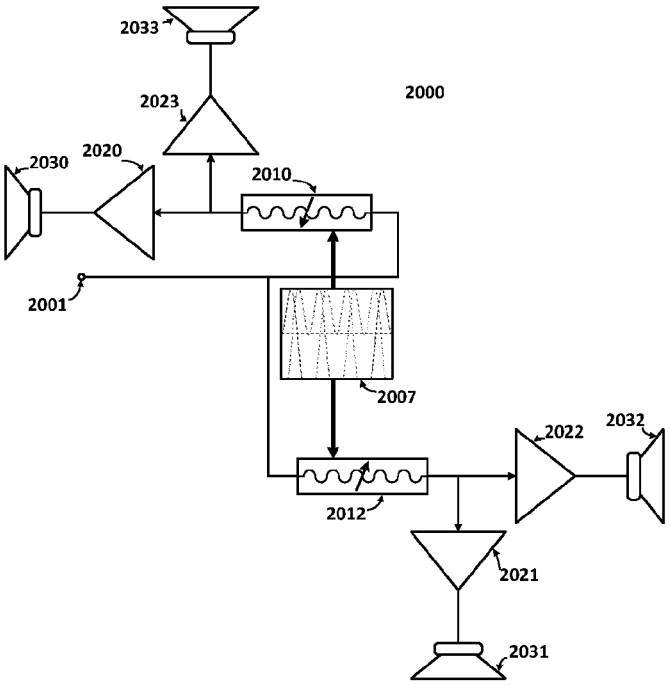
Figure 20 – Minimal Electronic Celeste
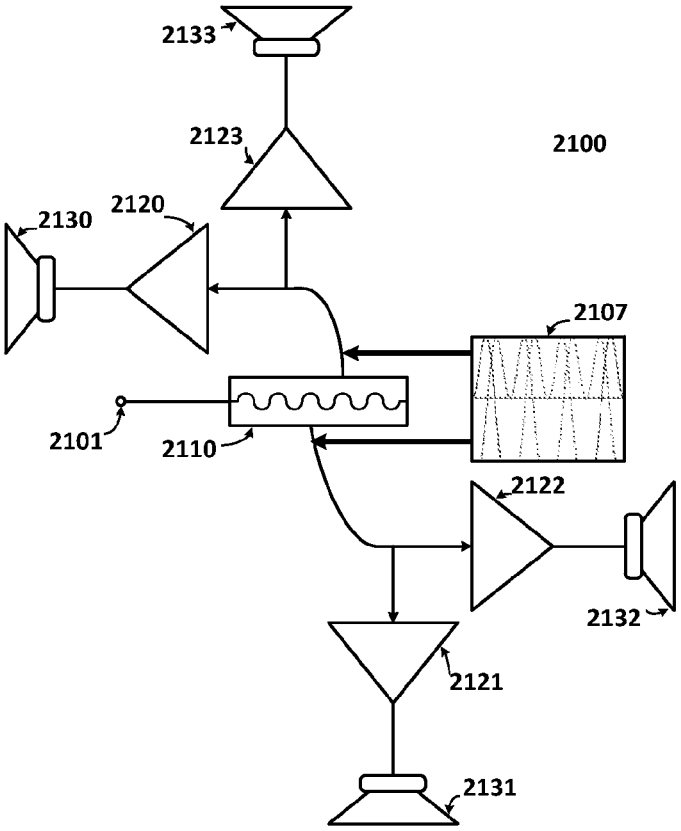
Figure 21 – Single Buffer Electronic Celeste

APPARATUS AND METHOD FOR A CELESTE IN AN ELECTRONICALLY-ORBITED SPEAKER

BACKGROUND OF THE INVENTION

Electronic and electro-mechanical musical organs have always suffered from lack of expression because the tones produced were simply keyed on and off, could be sustained indefinitely with no attack or decay and were rather pure, unchanging tones. In wind-driven pipe organs this problem is solved with a mechanical tremulant that varies the wind pressure at a sub-audible rate imparting a vibrato, or pitch variation, and a tremolo, or volume variation, to the tones of the pipes, thus adding excitement to the sound. Often multiple tremulants were used for separate ranks of pipes.

In addition to the tremulant, another technique to improve the sound of a wind organ is the celeste, where multiple ranks of slightly off-tuned pipes where played together to produce a very low frequency undulation in the sound and a complex cancellation and reinforcement of harmonics. This effect is very similar to the process that makes stars twinkle, or move around and vary in brightness. Different paths through the atmosphere have slightly different delays and cause the light to cancel or add and appear to arrive from a slightly different spot in the heavens. The wave lengths of sound waves are much longer than visible light, so the effects of cancellation and reflection can move the sound around a larger space in a pleasing and exciting way.

In electric organs, the vibrato effect is often imparted electronically; though, this is less than ideal as the sound is too precise and comes from a single speaker. If the celeste effect is attempted by purely electronics means, it suffers the same short-coming of emanating from a single or pair of speakers. In live performance venues, only the listeners in the stereo sweet-spot hear the spatial effects while most listeners, including the musician, miss out. In the case of the pipe organ, the pipes are physically spread; and the sounds come from multiple directions. To achieve both the vibrato and spatial effect for electric organs, it became common to use a mechanically-orbited speaker where the sound sprays in different directions as the sound transducer spins about. Many attempts have been made to capture the sound of the mechanically-orbited speaker by electronic means and reproduced by a stereo-sound system with disappointing results.

As the transducer orbits in a mechanically-orbited speaker; the apparent source of sound, the mouth of the horn, moves toward and away from the listener. As the source moves toward the listener, the pitch would rise; and as the sound moved away, the pitch would fall. This pitch change is due to the Doppler Effect. The sound would reflect from various surfaces in the room, producing the spatial effect. In a happy accident, the cabinet selected for the original commercial models of mechanically-orbited speakers interacted with the orbiting source of sound and added a celeste-like effect. At low speeds the celeste effect dominates over the Doppler Effect and is a highly desired feature of the speaker. Unfortunately, this cabinet construction also limits the sound output of the speaker due to the narrow slots. In efforts to increase the sound output, modifications to the cabinet lost the celeste effect.

While mechanically-orbited speakers have been popular in the past, they suffer from several drawbacks. To produce the vibrato effect over the desired range of musical frequencies, the transducer must spin. The speaker cabinet must be rather large and heavy, making it difficult to transport to live shows. The mechanical parts are delicate, requiring frequent maintenance. Attempts have been made to implement mechanically-orbited speakers with rotary joints to conduct sound signals to the orbiting transducers, but noise from the sliding contact and maintenance issues caused this approach to be abandoned.

Synchronizing multiple mechanically-orbited speakers is difficult, and a single physically rotating transducer has limited sound volume output. Venues have grown in size; and audiences have come to expect a full sound, so many performers resort to placing the orbiting speaker in a sound-isolated location, using a microphone and sound amplification system with multiple speakers. This results in loss of the desirable interaction of the speaker and the listening room.

Because the physical size of the orbiting speaker defines the acoustic performance, smaller and less expensive mechanically-orbited speakers do not achieve the desired musical effect, especially losing the desired frequency modulation by only rotating instead of orbiting.

Often mechanically-orbited speakers have only two speeds and no opportunity to vary the effect without physically modifying the speaker, thus, having a very limited expressiveness. This leads to playing techniques that resort to rapidly switching the drive motors on and off in an attempt to achieve intermediate speeds.

Keyboard players often have two or more instruments, or even one instrument, that can emulate more than one acoustic instrument, such as a synthesizer, that can produce tonewheel organ or piano sounds. Mechanically-orbited speakers have difficulty reproducing piano sounds without coloring and cannot reproduce uncolored piano and orbiting organ sound simultaneously. The traditional solution to this problem has been to add an additional pair of amplifiers and speakers dedicated to the stationary channels, adding weight, size and cost to the speaker system.

There is a need in the art for a speaker system to amplify musical instruments that can produce the desired vibrato, tremolo and celeste spatial effects while being lighter and more rugged for transport, having no moving parts to avoid frequent maintenance, being able to achieve the desired vibrato, tremolo and celeste spatial effects in a low-cost configuration, or being able to be driven at high power levels and having multiple orbiting speakers ganged for higher sound levels, having the ability to vary the musical effect for increased expressiveness, and producing uncolored sound simultaneously with vibrato, tremolo and celeste spatial effects.

BRIEF SUMMARY OF THE INVENTION

It is, therefore, the object of the present invention to enable a sound-system design for live performance of music with realistic tremulant and celeste spatial effects in a physical configuration that lends itself to light-weight portability, low maintenance and low-cost manufacture. Instead of mechanically-orbited sound transducers, the present invention uses two or more fixed sound transducers facing in different directions with the sound signal modulated separately for each transducer, as to impart the sense of orbiting as the sound reflects around the room and of a very low frequency undulation in the sound and a complex cancellation and reinforcement of harmonics due to combination of sound from a plurality of differentially directed transducers.

The sense of direction of sound in the present invention is increased by using fixed-sound transducers or groups of transducers selected and arranged to produce the appropriate sound radiation pattern for the desired effect. The transducer array extends the tremulant and celeste effects to lower frequencies and selectively deepens the effects over that achieved by existing mechanically-orbited speakers.

Because the orbited effect is imposed electronically, the same set of amplifiers and sound transducers can be simultaneously used to amplify and project sound without the tremulant and celeste or other effects or with a different set of effects. This makes it practical for a musician to use a single sound system for organ-sound reproduction with strong tremulant at the same time as electric piano having no tremulant, or with a light tremulant appropriate for the desired piano sound. This multiuse can be extended to any combination of instruments, voice or any other sound source.

Embodiments of the present invention lend themselves to addition of other sound effects particular to orbiting speakers, including simulation of horn-throat distortion, overdrive of the amplifier, amplifier- and speaker-cabinet emulation, and spatially-diverse reverberation simulation. For various reasons described below, mechanically-orbited speakers have limitations on the amount of sound output a single unit can produce and ganging multiple units may result in the tremulant effect being degraded. The present invention achieves higher sound level from multiple transducers in a single unit and allows for multiple amplifier/transducer units to be ganged for even higher sound levels while maintaining the quality of the synchronized tremulant and celeste effects.

BRIEF DESCRIPTION OF DRAWINGS

FIG. 1—depicts a rank of wind driven organ pipes with a tremulant.

FIG. 2—shows the cross section of a pipe organ tremulant.

FIG. 3—depicts a rank of pipe organ pipes with tremulant and celeste.

FIG. 4—shows the internal mechanism of a popular organ sound system.

FIG. 5—shows the outside view of the sound system of FIG. 4.

FIG. 6—shows the sound paths from the transducer in the sound system of FIG. 4 to the listener's ears.

FIG. 7—is a cross section of the horn used in the sound system of FIG. 4.

FIG. 8—is an amplitude/frequency plot of a comb filter.

FIG. 9—is a block diagram of an electronic flanger.

FIG. 10—is a block diagram of a stereo electronic flanger.

FIG. 11—depicts the stereo sweet-spot.

FIG. 12—depicts the full coverage of an electronically-orbited speaker system.

FIG. 13—shows an electronically-orbited speaker enclosure where the cone-type transducers have a front-loaded horn.

FIG. 14—shows the construction details of the electronically-orbited speaker.

FIG. 15—shows the basic signal connections of an electronically-orbited speaker.

FIG. 16—is a plot of the four amplitude envelopes of the four signals intended for the four sets of sound transducers, one signal for each face of the cabinet, in this case a complex modulation.

FIG. 17—is a signal flow diagram of a fully featured signal processor.

FIG. 18—is a block diagram an embodiment of an electronic celeste, the subject of the present invention.

FIG. 19—is a top view of the sound paths from the transducers of an electronic celeste to the listener's ears.

FIG. 20—is a block diagram a second and reduced complexity embodiment of an electronic celeste.

FIG. 21—is a block diagram single delay buffer embodiment of an electronic celeste.

DETAILED DESCRIPTION OF THE INVENTION

The detailed description set forth below in connection with the appended drawings is intended as a description of exemplary embodiments of the present invention and is not intended to represent the only embodiments in which the present invention can be practiced. The term "exemplary" used throughout this description means "serving as an example, instance or illustration" and should not necessarily be construed as preferred or advantageous over other exemplary embodiments.

This detailed description includes specific details for the purpose of providing a thorough understanding of the exemplary embodiments of the invention. It will be apparent to those skilled in the art that the exemplary embodiments of the invention may be practiced without these specific details. In some instances, well-known structures and devices are shown in block diagram form in order to avoid obscuring the novelty of the exemplary embodiments presented herein.

In particular, the exemplary embodiment is described in terms of a unit with four faces with associated amplifiers and sound transducers; but this number could be any number from two to some larger number limited by cost and complexity concerns. The faces of the unit may be deployed horizontally, vertically or in any configuration where the sound of two or more transducers is directed in different directions.

In the exemplary embodiment, the signal processing function is described as, but not limited to, a digital signal processor. Some or all of the signal processing may be implemented by other means, such as, but not limited to, analog circuits, standard computing components, or any other electronic or electrical means.

The term "celeste" is used herein to mean a sound effect that imparts a sense of motion and a variation in the relative strengths of the fundamental and harmonic tones in a periodic way. This variation usually takes place at a slow rate of a few times per second or once every few seconds.

The term "orbiting speaker" is used herein to mean any form of loudspeaker or sound-amplification device or sound-modification device intended to modulate or change the sound of a musical instrument or other sound source in a periodic way, especially to impart a periodic varying of pitch, amplitude or spatial perception. Orbiting speaker is intended to cover speakers that are commonly referred to as rotating or rotary speakers. The orbiting speaker may be a stand-alone device or collection of devices, or be part of a musical instrument.

The term "rotate" is used herein to mean the motion of an object that turns on its own axis.

The term "orbiting" is used herein to mean the circular motion of an object around a central point. In particular, the horn mechanism in a mechanically-orbited speaker rotates. The apparent sound source at the mouth of the horn orbits.

The terms "signal processor", "digital signal processor" or "DSP" may be a purpose designed computing device, a general purpose computing device, a collection of analog or digital electronic circuits, or a combination of any of the above.

The term "transducer" is used herein to mean a device that converts one form of energy into another. In particular, a sound transducer converts electrical signals into sound waves.

The term delay is used herein to mean a time delay that causes a sound to arrive at a later time to the listener. The term delay, when applied to celeste effect, means a time delay of less than 5 milliseconds, which is perceived by a listener to be a single sound when heard along with the original sound. The term delay, when applied to reverberation effect, means a time delay in excess of 5 milliseconds, which is perceived as a separate sound when heard along with the original sound.

A major part of the thrilling sound of a full wind-driven pipe organ is the undulating sound imparted by the tremulant mechanism 100 depicted schematically in FIG. 1 connected to a rank of pipes 103, 104. The wind, or air pressure from an air pump (not shown) is introduced through the tremulant 101 and then into the wind chamber 102. Individual valves (not shown) at the base of each pipe 103, 104 are controlled by the keys on the organ console (not shown). When a key is depressed, the valve for the associated pipe 103 is opened and the air exits the opening 110 causing the air column in the pipe 103 to oscillate at its resonant frequency and sound a musical note.

A cross section of a pipe organ tremulant is shown in FIG. 2. Air pressure is introduced from the air pump (not shown) through a pipe 201 into the box made up of an upper fixed portion 203 and a movable lower portion 202 connected by a bellows 204. Air pressure continues on to the air chamber 102 in FIG. 1. The lower portion of the box 202 is suspended by springs so it may move up and down, compressing the bellows 204 and the air contained therein. An electric motor 205 is fixed to the bottom of the lower portion of the box 202. A disk 206 is mounted on the shaft of the motor 205 and a weight 207 is mounted off-center on the disk 206. As the motor 205 rotates, the off-center weight 207 causes the lower portion of the box 202 to vibrate up and down. This vibration alternately compresses and rarefies the air contained in the box 202, 203, 204. This variation in air pressure causes the tone of the musical note produced by the pipes 103, 104 to vary up and down in frequency and intensity. The variation in air pressure also causes the harmonic content of the musical tone to vary, making a very complex shimmering sound.

A rank of organ pipes with a celeste is shown in FIG. 3. The tremulant mechanism 301 and wind chamber 302 are as described in FIG. 1. Instead of a single row of pipes, the celeste rank includes two rows of almost identical pipes 303, 305 for each note. Some celeste ranks include three or even four rows of pipes.

When two pipes sound the same or make a very close musical note, the sound takes on a richness and spatial character. Pairs of pipes are often tuned slightly off to produce a beat note at a very low frequency between one-half to 3 beats per second. Because the musical notes are coming from different positions, the waves from each pipe sometimes reinforce the other and sometimes cancel. The harmonics reinforce and cancel at different times and rates, derived from the very low frequency beat notes, producing a varying timber and depth not achievable with a single rank of pipes or with pipes of different types played together. This slow variation in harmonic content and sense of source of the sound of a musical note is highly sought after by musicians. A more recent method of producing the sound of a tremulant and celeste uses a sound source that moves in a circle or orbit.

Existing orbiting-speaker effect units are available in two forms: mechanical or electronic. The mechanism of the mechanical-type orbiting speaker is depicted in FIG. 4. The cabinet 400 is usually made of heavy wood to support the spinning machinery. The high frequencies are reproduced by a rotary horn 401 at the top of the cabinet and the low frequencies are reproduced by a cone-type speaker 410 at the bottom.

The rotary horn 401 is counter-balanced by a dummy horn 402. Sound is produced by a compression-driver unit 404 and is passed upward through a rotary joint and pulley 403. The horn assembly is rotated by an electric motor and belt 405. In most modern orbiting speakers, there is a second motor, not shown, to rotate the horn at a different speed, providing both a high- and a low-speed modulation effect.

The low-frequency, cone-type speaker 410 fires downward into a rotating drum 411 made of light-weight wood or other material. The drum has a scoop-shaped section that turns the sound toward the side of the cabinet 400 where there are slots to allow the sound to exit the cabinet. The drum 411 is rotated by the electric motor and pulley system 412. Like the horn in modern units, there are two motors, one for high speed and one for low speed. The second motor and clutching system is left out of the diagram for simplicity. The drum 411 is typically rotated in the opposite direction than that of the horn 401. Because of the limitations of the size of the low-frequency sound transducer 410 and rotary drum, there is little frequency modulation effect; and the amplitude modulation is imparted largely by the mouth of the deflector drum passing by the slots in the cabinet.

As the playing style of many tonewheel organists includes switching often between the high speed and low speed or even stopping rotation of the speakers, the belts and clutching mechanisms 403, 405, 412 require frequent maintenance.

FIG. 5 depicts the outside of the cabinet 500 of a typical mechanically-orbited speaker. The size of the cabinet affects the sound and only cabinets in a narrow range of size and particular configuration achieve the desired effect. In particular, there are slots on all four sides of the cabinet to allow sound to exit. One set of slots 501 at the top interact with the rotating horn and vary the amplitude and frequency response of the high-frequency sound as the horn spins. The other set of slots 502 interacts with the cone speaker and rotating drum to vary the amplitude and frequency response of the lower frequencies.

How the mechanically-orbited speaker produces the celeste effect is depicted in FIG. 6. This is a top-down view with the rotating horn inside the cabinet exposed for clarity. The horn 603 that is the source of sound rotates around the pulley and bearing 605 and is counter balanced by dummy horn 604. The horn mechanism and the sound it produces is contained in cabinet 601 and escapes the cabinet only through narrow sound ports 602 on all four faces of the cabinet. The sound from the horn 603, when it is positioned pointing to the right will escape by two exemplary paths 610, 611 on the way to the listener 606. The sound by path 610 is shorter so it reaches the listener 606 first. The sound by path 611 must travel the width of the cabinet before exiting, which produces a short delay or phase shift of the sound waves and this sound arrives at the listener later. It is important that the delay be very short so that it is perceived as a single sound and not a reverberation component. Nevertheless, the sound arriving by two different length paths combines and results in reinforcement or cancellation, the same process as described for the pipe organ celeste. The paths 610 and 611 are shown reflecting from walls of a room 607 and 611 for clarity of drawing, but the paths may arrive at the listener directly from the sound ports 602 or by single or multiple reflections. This is how the mechanically-orbited produces a celeste effect that has escaped reproduction by purely electronic means for live performance situations.

Because these sound ports 602 are constricted in size, the sound coming out each port is close to the same intensity, which is key to producing the desired celeste effect. As shown in FIG. 7 a further step the designer of the mechanically-orbited speaker took to balance the sound coming out all the ports was to put a sound diffuser 705 in the mouth of the horn 701. Sound enters the active horn 701 from the bottom at 701 and has to exit the horn mouth 706 to the side and not straight out the sound port 602 that the horn 701 is pointed towards. Sound is blocked at 703 so it cannot exit via horn 707, which exists only to provide mechanical counterbalance. The horn structure is supported by and revolves around the pulley and bearing 704.

A popular explanation of the operation of a mechanically-orbited speaker ascribes the tremulant sound to the Doppler Effect. While this may be true, it is only part of the story. The celeste effect described here becomes dominant at the slower speed. Experiments show that rotating the horn very slowly by hand reveals sharp changes in the tone quality produced by phase cancellation, something quite different and richer than the simple frequency modulation produced by Doppler alone.

FIG. 8 is a plot of the comb filter amplitude verses time of the results of phase cancellation. Line 810 represents the amplitude of a single sound source. Lines 801, 802, 803 represent the amplitude of the sum of two sound sources of equal amplitude and varying distance between them. The different lines show the results of different relative delays between the two sources. The varying distance results in a varying phase difference between the sources. When the two sound sources add in phase, they reinforce each other, resulting in the amplitude rising 3 dB or a doubling of amplitude above the single source amplitude 810. This is known as a flare. When the sounds from the two sources add out of phase, they cancel, and the amplitude falls below the single source amplitude 810. This cancellation, known as a fade, may be up to 30 dB or one one-thousandth of the amplitude of the single source. The terms flare and fade come from the observation of stars through the turbulent atmosphere where variations of index of refraction cause light rays to bend and make stars appear to move slightly and vary in brightness, also known as twinkling. The same phenomenon effects radio communications where it is known as multipath fading and heard as picket-fencing on FM broadcasts while listening in a moving automobile.

In the orbiting speaker this process of reinforcement or cancellation varies with frequency. The fundamental of a tone may be reinforced while a harmonic is cancelled or vice versa. As the horn turns in the cabinet, the pattern of reinforcement and cancellation verses frequency changes as the sound path lengths change, as represented by curves 801, 802, 803. This means fundamental tones will be changing independently of harmonics as the horn revolves. Thus, the designer of the mechanically-orbited speaker captured the sound of a true celeste by imparting physical motion to the sound. The combination of the orbiting of the omnidirectional sound source (the horn with diffuser) and the constricted cabinet ports creates the spatially separated sound sources with time delays.

In the quest to produce a celeste effect, many electronic means have been used. Analog bucket-brigade devices and digital-delay lines are popular. All of these means are represented by the block diagram 900 in FIG. 9. A sound signal from a musical instrument or other source is introduced at 901. The sound signal is divided with part coupled to delay line 902 and part coupled directly via path 903 to summing junction 904. The signals from the delay line 902 and the direct signal via 903 are added at summing junction 904 and coupled to audio amplifier 905 that drives sound transducer 906 to produce sound waves. The delay line 902 is capable of varying the delay by at least half the period of the audio frequency of interest. The variation in delay is controlled by oscillator 907 that operates at a sub audible rate.

As the delay is varied the comb filter depicted in FIG. 8 sweeps back and forth in frequency, accentuating or suppressing different audio fundamentals and harmonics. Early attempts at producing the celeste effect involved a pair of magnetic tape recorders playing back the same recording and the engineer dragging a finger on the flange of one of the tape reels, which gave the effect the name flanger. It is also called a chorus effect and is built into many musical instruments and sound processing units. The drawback is that the purely electronic effect sounds unnatural and does not provide the spatial movement of a real celeste.

In an attempt to provide some spatial movement, the flanger may be implemented in a stereo pair as shown in block diagram 1000 form in FIG. 10. The signal path is made up of the same components as 900 but duplicated for a left and a right channel. A single sound signal may be divided and coupled to both inputs 1001, 1011 or a musical instrument or other sound source that already provides a stereo pair may be coupled separately to the left 1001, 1002, 1003, 1004, 1005, 1006 and right channels 1011, 1012, 1013, 1014, 1015, 1016. The delay control signal from the sub audible oscillator 1007 may be the same for both channels or may be anti-phase or some other phase relationship. Driving both channels with the same phase control signal does not produce a sense of movement as both channels shift in the same direction. Driving the phase control in anti-phase provides a sense of movement but the reinforcement and cancellation of fundamentals and harmonics tend to be lost. What affect the flanger does produce is heard only in the stereo sweet-spot as described below.

FIG. 11 depicts a typical live performance venue 1100 in simplified form with a stereo sound system 1104, 1105. The stage 1101 supports the musician 1103, a musical instrument 1102 and a pair of stereo speakers 1104, 1105. The audience is made up of listeners represented by positions 1106, 1107, 1108. Listener 1107 is located in the stereo sweet-spot where the intensity of the sound from both the left 1104 and right 1105 speakers is balanced and any sound effects generated in stereo are heard and appreciated properly placed on the stereo sound stage. Listener 1106 hears mostly just the left speaker 1104 and stereo effects are lost on this listener. Likewise Listener 1108 hears mostly the right speaker 1105 and again the stereo effects are lost. The musician 1103 is in the most disadvantaged listening position, which explains the popularity of in-ear monitors to block out the sound of the stereo-sound system while hearing their own playing in the proper stereo image.

In FIG. 12 the stereo-sound system of 1100 is replaced with an orbiting speaker 1204. The stage 1201 supports the musician 1203, the musical instrument 1202 and the orbiting speaker 1204 in an arbitrary position. As the sound orbits, each listener 1206, 1207, 1208 and the musician 1203 enjoy the full tremolo, vibrato and celeste effects of the orbital speaker 1204 because the sound is directed from all faces of the speaker cabinet equally; and the effects are equally strong at any position relative to the orbiting speaker 1204, avoiding the problem of the stereo sweet-spot. This is a well-known effect and considered the ideal live-performance configuration by many top musicians.

Some mechanically-orbited speaker manufacturers have not understood the value of the interaction of the orbiting sound transducer interacting with the cabinet. They produce products with stereo microphones mounted inside the cabinet in an attempt to capture the tremolo and celeste effect so the sound of the orbiting speaker may be reinforced with a larger sound amplification system. The result is a strong amplitude modulation effect with limited frequency modulation and very little of the celeste effect.

The solution to the needs enumerated above is the electronically-orbited speaker of the present invention described herein. The US application published as US2013/0163787 describes the basic operation of the electronically-orbited speaker system and is incorporated herein in its entirety.

A simple exemplary embodiment would consist of four separate acoustic transducers mounted on the four vertical faces of a box. Each transducer would be driven by a separate electronic amplifier. The amplitude of drive to each transducer is modulated by any electronic means. Improvements in high-power, class D audio amplifiers and switch-mode power supplies make it very practical and cost effective to have several amplifiers integrated into one product. These amplifiers and power supplies are very efficient, produce little heat and are considerably lighter in weight than traditional audio amplifiers.

In FIG. 13 is shown an example of an electronically-orbited speaker 1300. In this embodiment, the sound signal from the organ or other musical instrument is taken as input to a digital signal processor, known as a DSP. The DSP would divide the signal into four signal streams. Each stream is modulated to impart an amplitude envelope that corresponds to the sound level that would be experienced by an orbiting sound source as it passed across a face. If the virtual orbiting sound source were pointed toward the listener, the DSP sends the maximum signal to the amplifier driving the transducers 1301, 1302, 1305 on the front face of the box 1300. Transducers 1301, 1302 are cone type transducers for mid-range frequencies. Transducer 1305 is a horn type transducer for higher frequencies. As the virtual sound source orbits to the right, the transducers 1303, 1304 on the right side of the box 1300 are driven at higher levels; and the drive to the front transducers 1301, 1302, 1305 is reduced.

Between the two conditions described above, when the virtual orbiting-sound source is pointing at the corner of the box, the drive levels to both the front and right side transducers 1301, 1305, 1303 are equal and at some typically lower-power level, thus sounding like a single transducer pointed toward the corner of the box. This process continues, handing off the audio power from one transducer to the next as the virtual-sound source orbits in a complete circle. This is a very simple description of the action of the electronically orbited speaker; and there are many factors that improve the musical effect, which are described in more detail in the referenced application and more briefly below.

Fundamental to the success of the orbiting-speaker effect is the radiation patterns of the acoustic transducers. The patterns must be narrow enough to provide the desired effect of the sound spraying out in different directions as the virtual-sound source orbits. If the transducers have a very wide radiation pattern, there is little change in the sound no matter which way the speaker is pointed. The ideal transducer pattern for an electronically-orbited speaker with four sides would be a single beam approximately 90° wide. However, real transducers do not have a single radiation pattern for all frequencies. Higher frequencies tend to have a very narrow pattern; while at lower frequencies, the pattern broadens until it becomes almost omnidirectional. This effect is dominated by the size of the transducer. A transducer with an effective diameter of approximately one wavelength produces the ideal 90° pattern.

$$\text{wavelength}=344/f \qquad \text{Sound wavelength formula}$$

f in Hertz wavelength in meters

The exemplary embodiment 1300 shows an improvement to the sound radiation pattern of the mid-range frequencies, extending the orbiting sound-source effect to lower frequencies in a simple but effective manner. Considering a single cone-type transducer 1301 of a typical 150 millimeter diameter, and using the formula, the transducer loses directionality below 2293 Hertz. By adding a second identical transducer 1302 spaced 0.75 meter center-to-center, a line array is established. The effective diameter for the horizontal radiation pattern calculation becomes 0.75 meter, considerably narrowing the pattern at lower frequencies. The proper directional radiation pattern would be maintained down to 458 Hertz, thus extending the orbiting sound-source effect into the middle of the musical spectrum in a simple and cost-effective manner. The scheme is extended to each face with the transducers 1303 and 1304 making up the line array of the right face.

Classical mechanically-orbited speakers often have a deflector plate attached to the mouth of the horn in an attempt to spread the sound radiation pattern at higher frequencies. Musicians often removed the deflector plate and/or removed parts of the cabinet to achieve different musical sounds. In the electronically-orbited speaker system, the DSP may divide a frequency band dedicated for a specific transducer into sub-bands and modulate the signal with different amplitude envelopes for each sub-band to equalize the sound radiation pattern between sub-bands. Alternatively, the amplitude envelopes may be selected to emphasize the difference of radiation pattern between sub-bands. By doing so under player control, the electronically-orbited speaker system can emulate the sound of different models and configurations or modifications of classical orbiting speakers.

Some players prefer to use two classical mechanically-orbited speakers. Each rotor in each speaker rotates at a slightly different rate, making for a very complex variation in the tremulant effect. The DSP of the electronically-orbited speaker system may use a plurality of amplitude envelopes running at different speeds to provide this complex tremulant effect. The delays to impose a reverberation effect may be different for each amplitude envelope to provide the illusion that the virtual rotors are in different physical locations.

Mechanically-orbited speakers often have a feature where the rotor is stopped by a brake with the transducer facing front to provide maximum sound level in the non-orbiting configuration. The DSP of the electronically-orbited, upon receiving a command to stop the virtual orbiting, may continue the current orbit until the virtual transducer reaches front center where it may stop and ramp the amplitude to maximum regardless of the amplitude envelope at that point. As the virtual orbiting transducer accelerates or decelerates, the amplitude envelope may be changed to emphasize the tremulant effect.

The size of a transducer also affects the efficiency in converting the electrical signal to sound. A smaller transducer works better at higher frequencies while a larger transducer is needed to reproduce the longer wavelengths of lower frequencies. The electrical signals may be divided into bands appropriate for each transducer by a crossover network and each transducer driven with only the signals it can reproduce well. Dividing the musical spectrum up to be reproduced by separate transducers also helps the variation in radiation pattern with frequency. A smaller transducer maintains a narrow radiation pattern only in the upper frequencies. A larger transducer provides a narrow radiation pattern at lower frequencies, though even a very large transducer becomes omnidirectional at the lowest musical frequencies.

This problem of needing to use different sizes of transducers is not unique to electronically-orbited speakers. The best mechanical-orbited speakers use a rotating high-frequency transducer and a separate rotating low-frequency transducer. To deepen the musical effect, the two transducers are typically rotated in opposite directions.

The electronically-orbited speaker in another exemplary embodiment uses a high-frequency transducer and one or more low-frequency transducers on each of the four faces of the box. Each transducer or transducer array has an associated amplifier. The DSP divides the input signal into two frequency bands performing the crossover function, one band for the high-frequency transducers and one band for the low-frequency transducers. The DSP then divides the signal for each band into four signal streams for each of the transducers on each face of the box. Each of the two sets of four streams is coupled to the associated amplifier. The orbiting is imparted by the same amplitude envelope method as described above. In this case, the high-frequency set is orbited in one direction and the low-frequency set is optionally orbited in the opposite direction.

In further description of FIG. 13, an electronically-orbited speaker 1300 comprised of a horn-type transducer 1305 mounted in the center of each face and a pair of cone-type transducers 1301, 1302 with front-loaded horns at the extremes of each face. The details of construction are shown in FIG. 14. The horn-type transducer 1305 produces the desired narrow sound radiation pattern for the highest frequency-band. The pair of cone-type transducers 1301, 1302, by being driven with the same signal, operates as a line array giving the effect of a single larger transducer. This produces a sound-radiation pattern appropriate for the mid-range frequency.

The sound transducers 1301, 1302 are behind a front-loaded horn made up of the transducer baffle, the walls of the cabinet and the septum 1310. This arrangement allows the center of sound radiation of each transducer to be close to the edge of the cabinet for widest speaker array possible and provides some improvement in efficiency of the transducer.

FIG. 14 shows 2D views 1400, 1450 of the construction of a high-power, electronically-orbited speaker unit. In the top view 1400, the top of the box is removed to show the internal construction. The four faces are divided by walls on the diagonal 1402 that form one wall of the front-loaded horn space 1401. Each cone-type transducer 1403 is mounted in a baffle that forms the opposite wall of the front-loaded horn 1401. The horn-type transducers 1404 are mounted in the center of each face. Internal spaces around the horns are used for electronics modules 1405, 1406. The front view 1450 has the front panel removed to show the internal construction.

Class D power amplifiers can achieve high power with efficiency exceeding 90 percent, which reduces heatsink size and ventilation air requirements. Class D amplifiers of medium-power are available quite economically in a single integrated circuit package, while high-power amplifiers may be constructed with minimal component size and number. A switch-mode power supply eliminates the large and heavy 50/60 Hz power transformer and also operates at high efficiency. This makes it practical to have multiple amplifiers, one for each horn-type transducer and one for each pair of cone-type transducers. For extremely high-power applications, the electronics may be mounted external to the transducer cabinets, driven by cooling considerations. The signal processor function may be integrated into the speaker cabinet, part of a separate electronics package that includes the power amplifiers, or may be a separate physical unit or connected units. The signal processor function may be performed by a standard computing device coupled with the amplifiers and sound transducers. The computing device may be a personal computer, laptop computer, notebook computer, tablet computer, smartphone or any other computing device.

FIG. 15 shows the signal flow of an electronically-orbited speaker with cone-type transducers 1502 for the mid frequencies, and horn-type transducers 1501 for the high frequencies, and line-level output 1515 for the low frequencies to be routed to an external subwoofer. This specialization of type of transducers for each frequency band improves the matching of sound-radiation pattern for the desired effect. The cone-type transducer 1302 is shown as a single transducer for clarity. Typically, two or more transducers would be employed in a line array to produce the tight sound-radiation pattern required to produce the spatial effect.

A line-level audio signal is provided to the Instrument Input 1510 by the sound source, typically a musical instrument. The signal is processed by the DSP 1520 by being split into four pairs of signals used to drive each face of the unit and modulated to produce the orbiting effect. Four signals are bandpass filtered by the DSP for the mid frequencies and four signals highpass filtered for the high frequencies. Pairs of signals, one mid and one high, drive each face. Each face has a dedicated power amplifier 1531 to drive the pair of cone-type transducers 1502 and a second power amplifier 1530 to drive the high frequency horn transducer 1501. A line-level subwoofer output 1515 is filtered by the DSP to only allow the bass frequency signal to pass to the subwoofer (not shown) for amplification by a larger transducer.

The PA Input 1511 is a stereo pair. It is similarly, but separately, split and processed by the DSP and summed at each of the nine outputs to the amplifiers. The right and left channels of the stereo pair are summed into the faces of the speaker with different gains to produce the desired stereo effect.

The control input 1512 may be of one or more types and multiple types may be incorporated into any particular embodiment. One interface may emulate the existing popular mechanically-orbited speaker with discrete signals for fast and slow speeds and a brake to stop rotation. Other control inputs may use the Musical Instrument Digital Interface (MIDI) protocol to control various parameters of operation including, but not limited to, fast and slow speed, stop, variations in speed for each of the high- and mid-frequency channels, acceleration and deceleration of the virtual rotors, crossover frequencies, envelope profile selection (described later), distortion effects thresholds and many other parameters. The MIDI interface may use the MIDI signaling definition or be implemented via Universal Serial Bus (USB) as are many musical instruments.

The fundamental orbiting speaker effect is produced by splitting the input signal into one path for each face of the speaker enclosure and amplitude modulating the paths separately to sweep the sound in a complete circle. The sound is physically moved by imposing the appropriate amplitude envelope on the signal paths. The process of physically moving the apparent sound source and direction in a circle imposes both amplitude and frequency modulation on the sound. The amplitude modulation can be depicted as amplitude envelopes as shown in FIG. 16.

FIG. 16 is a plot of a simple set of amplitude envelopes for a four-faced speaker enclosure or cabinet. The vertical axis indicates the amplitude attenuation imposed on the signal. The horizontal axis indicates the rotational step. In this exemplary embodiment, the circle is divided into 256 steps. The DSP counts the steps and wraps around at the end. At count 0, the signal for the transducers on the front face is at half volume while all other signals are fully attenuated. As the steps increase, the front face signal increases to full volume and then is attenuated; and the left face signal is increased. At step 50, the front-face signal is fully attenuated and the left-face signal is at full volume. This process continues until the count reaches 256, which is the same condition as count 0.

This process is repeated for each orbit of the sound. The slow-speed effect is called "Chorale" and typically orbits at 45 RPM. The fast-speed effect is called "Tremolo" and orbits at approximately 400 RPM. Some models of mechanically-orbited speakers have multiple pulleys to change the orbiting speed but require disassembly of the cabinet to make the change. In the electronically-orbited speaker several orbital speeds are available, changed via the external control input. Similarly, the external control input provides selection of multiple amplitude envelopes for different orbiting effects.

To orbit in the opposite direction, the count is decremented instead of incremented. To produce these amplitude envelopes, a look-up table may be used or the values of the envelope calculated in real time. In the case of the look-up table, the full rotation may be represented by the segment of one of the envelopes from step 0 to step 64. The remainder of the circle may be simply produced by modulo arithmetic and incrementing the look-up table pointer up or down for the positive or negative slope of the curve. The shape of the envelope may be asymmetric to emulate an off-center rotating horn. The look-up table implementation is ideal for producing arbitrary envelope shapes. The speed of stepping through the envelope look-up table may be varied to emulate the variations, such as loose or worn belts and/or pulleys, inherent in mechanically-orbited speakers.

The physical configuration of sound transducers is key to producing the orbiting speaker sound, but the electronics provide an increased level of control and variation desired for a flexible sound-reproduction system. Though the effects described here may be implemented in various technologies, the DSP is powerful and cost effective. This exemplary embodiment will be described in terms of a DSP with embedded software that implements the components of the signal path.

FIG. 17 shows a simplified DSP signal flow diagram 1700. These features may be implemented as software, so they may vary, take a different order or have many other features added without changing the present invention. The main instrument input is provided at the connector 1710. The pre-gain adjust 1711, vacuum tube emulator 1712 and post-gain adjust 1713 optionally introduce amplifier distortion emulation to the signal input at 1710. This amplifier emulation takes the form of second-harmonic rich distortion to emulate overdriving the class A preamplifier stage, and third-harmonic rich distortion plus soft compression to emulate power amplifier overdrive. The speaker cabinet emulation may also be introduced at this stage by adding frequency shaping and cabinet-induced resonances. A compressor/limiter function 1714 serves the purpose of limiting volume peaks from overdriving the DSP. This effect may be adjusted to compress the dynamic range of the input signal to allow it to sound louder or leave the dynamic range uncompressed until the music peaks would clip in the DSP and only apply enough compression to avoid clipping.

The signal is then split into frequency bands by the highpass 1715, bandpass 1716 and lowpass 1717 filters. The signal from the highpass 1715 filter feeds the tweeters, the bandpass 1716 feeds the mid-range transducers and the lowpass filter 1717 is routed to a line-level output to be connected to the subwoofer. The signals from the PA or alternate instrument inputs 1720, 1725 routed through a similar set of signal function blocks, though the parameters, such as distortion models and crossover frequencies, may be different from the instrument input 1710 channel. There is a reverberation emulation block 1730 for each signal path. By splitting the reverberation emulation across the faces of the speaker, a spatial aspect of the reverberation effect is introduced that is lacking in the typical front-facing, stereo-sound system. The signals for the left, right and rear channels have different delays and arrive at the listener from different directions due to room reflections. This better emulates the effect of a larger room. Also, the tweeter and mid-range signal paths are treated differently to add frequency dependent aspects to the effect.

In this embodiment, the signal from the instrument input is shown as being routed through the amplitude envelope processing 1735, though the PA channel 1720, 1725 may optionally be routed through the instrument envelope processing or through a separate set of envelope processors (not shown).

The signals output from the envelope processors are then fed to signal mixers and then on to the appropriate amplifiers and sound transducers as shown in FIG. 15. The signal output from the envelope processor 1735 is connected to the mixer 1740 associated with the front tweeter. The signal from the lowpass filter is routed directly to the subwoofer signal mixer 1745 and then on to the subwoofer amplifier and transducer. Optionally, a ninth envelope processor may be added to the subwoofer path. The subwoofer envelope may be synchronous with the mid-range or entirely different to emulate a third orbiting sound transducer with its own set of speed and effect depth parameters.

Starting at the PA inputs, one for the left 1720 and one for the right 1725 stereo pair, there is a compressor/limiter function 1721 and crossover filters 1722, 1723 and 1724 as described previously. The crossover frequencies for the PA channel may be different from the instrument channel. In particular, the crossover frequencies for the instrument-signal path are selected to provide a narrow sound-radiation pattern as described in the support for FIG. 13. The PA-signal paths may have higher crossover frequencies to avoid the narrow-radiation patterns of the mid-range and tweeter and achieve a smoother overlap between the faces of the speaker system.

The lowpass 1724 signals from both the left and right PA channels are routed to the subwoofer mixer 1745, because the lowest frequencies have no apparent directional characteristics. The highpass 1722 and mid-range 1723 signals from both the left and right PA channels are routed separately to the mixers 1740. These channels would have further signal processing blocks (not shown) for amplifier and speaker cabinet effects, reverberation and amplitude envelope.

Before the PA channels are mixed, there may be individual gain adjustments to place the stereo image properly by routing the signals to the appropriate face or faces of the speaker system. In a simple example, the left PA-tweeter channel from the highpass filter 1722 would be routed with full gain at gain adjustment 1741 to the left-tweeter output mixer; and the right-channel highpass signal would be routed with full gain through gain adjustment 1743 to the right-tweeter output mixer. The left-channel mid-range signal from the crossover filter 1723 would be routed with full gain at the gain adjustment 1742, and the right-channel signal routed with full gain at gain adjustment 1744 to the right mid-range output mixer. In this simple example, all other gain adjustments would be set to the lowest setting to block the signals. For situations where a broader coverage was desired, the signals at lower gain may be routed to the front and rear faces. This is especially useful in cases where the audience surrounds the player.

FIG. 18 schematically shows the function of the celeste feature added to an electronically-orbited speaker. The other features and functions of the electronically-orbited speaker are omitted for clarity. The electronic celeste feature may be inserted before or after any of the other electronic effects described above. The celeste feature may be implemented as software in a DSP or general purpose computer, programmable logic, dedicated logic or by analog circuits or by any combination of the above. The delay line may be implemented in the memory of a DSP or general purpose computer, by digital means, by analog means, by transducers coupled with a mechanical or acoustic delay element, or by any other means available to delay a signal.

The electronic celeste 1800 is comprised of an input 1801, envelope generator 1807, variable delay lines 1810, 1811, 1812, 1813, amplifiers 1820, 1821, 1822, 1823 and sound transducers 1830, 1831, 1832, 1833.

The variable delay lines 1810, 1811, 1812, 1813 in one example are implemented as a circular buffer in DSP memory. The analog signal is typically sampled at a rate at least twice the highest frequency in the signal to be processed to meet Nyquist Criterion. A common sampling rate used is 48 Kilo samples per second with 24 bits of precision. The samples are stored in an area of random access memory coupled with the DSP. The DSP writes new samples into the buffer as they are converted from analog. An address pointer is used to keep track of where the last sample was stored. A second address pointer is arranged to point at a sample that was previously stored. Every time a new sample is stored, both pointers are incremented. Modulo arithmetic is used when incrementing the pointers such that the area of memory is used over and over, appearing to be a never ending circle. The second address pointer, besides being incremented every time a new sample is stored, may also be adjusted to vary the delay between the sample being stored in the buffer and the sample being retrieved from the buffer. This delay may be from zero to a few milliseconds.

To avoid a sound artifact known as zipper noise, caused by discontinuities in the sound waveform from changing the delay, the variable delay line may be oversampled, making the effective delay difference between delay buffer addresses smaller. To oversample, the input sample may have zero value samples inserted between each real sample, and then the result is low-pass filtered to create interpolated intermediate samples. The delay buffer must be made larger by the oversampling factor. An alternative technique is to use a fractional-delay line whereby the output address pointer has a fractional part that is used to interpolate between a pair of samples from the buffer. The oversampling and fractional-delay line techniques may be combined to further reduce zipper noise.

Assuming a sampling rate of 48 Ksps, to implement a delay line with a maximum delay of 3 milliseconds would require that the buffer length be at least 144 samples. Using the speed of sound of 340 meters per second, this delay represents a distance of 1.02 meters, the width of the largest orbital speaker cabinet. Delays larger than 5 milliseconds start to become heard as a reverberation instead of a celeste effect, so longer delays should be avoided. A delay of 3 milliseconds represents a phase shift of 180 degrees at 166.6 Hertz, the lowest frequency where a celeste effect may be reasonably created. These dimensions and performance match closely with those of mechanically-orbited speakers commonly in use.

A signal from a musical instrument or other source is introduced at the input 1801. The signal is divided four ways and couples to four variable-delay lines 1810, 1811, 1812, 1813. The output of each variable-delay line is coupled with the input of the associated amplifier 1820, 1821, 1822, 1823. The output of each amplifier is coupled to one or more sound transducers 1830, 1831, 1832, 1833, each pointed in a different direction. The amplitude of each signal path is modulated to impose the orbiting effect as described above and not shown for clarity. The delay of each signal path is varied, controlled by envelope generator 1807. The envelope generator produces a separate envelope for each delay line. The envelopes may be identical in shape but offset in phase from each other. For a four-sided cabinet, the phases would typically be offset by 90 degrees. The envelope generator operates in a fashion similar to the envelope generator used to drive the amplitude modulation as depicted in FIG. 16.

The envelope generator for orbiting and the envelope generator for celeste may or may not be operated in synchronization, allowing further variation and richness to be added to the sound of the instrument. The delay envelope may also be asymmetric to emulate an off-center rotation of a horn. The delay envelope may be as simple as a straight line, resulting in a triangle waveform that causes the output address pointers to sweep back and forth across the delay buffer at a constant rate. The delay envelope may be complex, as depicted in FIG. 16, or any other shape.

Unlike the mechanically-orbited speaker where the length and depth of delay that produces the celeste effect are fixed in the physical configuration of the rotating transducers and the cabinet, in the electronically-orbited speaker, the celeste effect is implemented in a signal processor that may be programmed to operate with various parameters under control of the musician. The delay envelope may be generated by incrementing and/or decrementing the output address pointers to produce increasing and decreasing delays. Different delay envelopes may be selected by addressing a different look-up table or applying mathematical functions to a single look-up table. Delay envelopes may be generated by mathematical functions or any other method that may generate periodic or aperiodic waveforms. A user interface may be implemented as part of the electronically-orbited speaker to command the signal processor to change any or all of the parameters described above. The parameters of the electronic celeste and the parameters of the electronically-orbited speaker may be controlled by an external device, such as a computer or other musical instrument. The external control may be communicated via a music industry standard interface, such as MIDI or MIDI over USB, or by any other communications medium.

FIG. 19 illustrates one set of conditions during the operation of an electronically-orbited speaker. This is a schematic top view 1900 with an electronically-orbited speaker 1901, walls of a room 1907, 1908 and a listener 1906. Assume the amplitude envelope of the orbiting effect has set the volume to maximum on the left face 1902. The sound will emanate from the transducers on side 1902 and travel via path 1911 as it reflects off the wall 1908 and on to the listener 1906. This emulates a mechanically-orbited speaker where the rotating horn would be closest to position 1902. In the electronically-orbited speaker, an attenuated and delayed version of the signal would be coupled to the sound transducers on the right face 1903 of the speaker. The delay emulates the sound from the horn in position 1902 travelling the width of the cabinet and exiting the sound ports on the right face 1903 of the cabinet. The sound from this source travels via path 1910, reflects from wall 1907 and on to the listener 1906 where the sound from the right face of the cabinet combines with the sound from the left face of the cabinet.

The sounds via the two paths sometimes add constructively and sometimes destructively producing the comb-filter effect depicted in FIG. 8. The speaker placement, walls and sound paths are shown as symmetric for simplicity. Placement and position is not important as only the relative phase of the two sound paths is important, not the absolute phase. As the source of sound orbits, the delays on each path increase and decrease relative to each other, causing the flares and fades of the comb filter to move in frequency producing the moving celeste effect. Because the orbiting speaker does not depend on the stereo sound stage, the celeste effect from the orbiting speaker is heard and enjoyed anywhere in the room.

FIG. 20 depicts a schematic of a simplified, electronic celeste effect. Listening tests have shown that four separate delays are not necessary; and that a celeste effect with only two delays combined with the orbiting effect provides a rich musical experience. A signal from a musical instrument or other source is introduced at 2001. The signal is divided and coupled to the inputs of two variable delay lines 2010, 2012. The output of variable delay line 2010 is divided and coupled to the inputs of two amplifiers 2020, 2023. Each amplifier output is coupled to its associated sound transducer or transducers 2030, 2033. Similarly, the output of variable delay line 2012 is divided and coupled to two amplifiers 2021, 2022, which are in turn coupled to their associated sound transducers 2031, 2032. The delay of each variable delay line 2010, 2012 is controlled by envelope generator 2007 that produces two delay envelopes with offset phase.

FIG. 21 shows a further simplification of an exemplary implementation of an electronic celeste effect 2100. Here a single variable delay line is used; however, the variable delay line has two or more outputs that may be independently varied. This will be describe in terms of a digital delay line implemented in DSP memory with address pointers controlling the delay between input and output, but any implementation of a delay line may be used without changing the present invention.

A signal from a musical instrument or other source is introduced to the input 2101 where it is compressed, sampled, filtered, modulated to inducing orbiting and optionally other effects not shown here for clarity. The samples representing the sound signal are coupled to the variable delay line 2110 where the samples are stored in memory; and an input address pointer locates the samples while the address pointers increment with modulo arithmetic, as described in FIG. 18. Where this configuration differs from the previous description is there are two or more output address pointers resulting in a plurality of outputs with different delays. In this example, delay envelope generator 2107 controls one output address pointer to couple a delayed signal, which is then divided and coupled to two amplifiers 2120, 2123. Each of these amplifiers 2120, 2123 is coupled to its associated sound transducers 2130, 2133. The delay envelope generator 2107 provides a second envelope phase shifted from the first, which controls a second output address pointer to produce a second output from the variable delay line 2110. These two output address pointers sweep back and forth across the delay buffer reading out samples with variable delays. When the delay for one output is at maximum, the delay for the other output is typically at minimum and vice versa. The variable delay line 2110 may optionally be configured with more outputs, such as four, so that each of the four amplifier/sound transducer pairs would have a unique delay with very little additional complexity over the two output variable delay line.

As can be seen from the description above, the electronically-orbited speaker with electronic celeste produces the rich and exciting sound of classical orbiting speakers while achieving many advantages, such as ease of transport, upgradability, higher sound-level output, easily changed characteristics and operation with two or more sound systems with independent characteristics.

Those of skill would appreciate that the various illustrative logical blocks, modules, circuits, and algorithm steps described in connection with the exemplary embodiments disclosed herein may be implemented as electronic hardware, computer software, or combinations of both. To clearly illustrate this interchangeability of hardware and software, various illustrative components, blocks, modules, circuits, and steps above have been described generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments of the invention.

The various illustrative logical blocks, modules, and circuits described in connection with the exemplary embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, analog circuit, discrete hardware components, vacuum tube, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the exemplary embodiments disclosed herein may be embodied directly in hardware, in a software module executed by a processor, or in a combination of the two. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD, DVD, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in an electronically orbited speaker with electronic celeste. In the alternative, the processor and the storage medium may reside as discrete components in an electronically-orbited speaker with electronic celeste.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media, including any medium that facilitates transfer of a computer program from one place to another. A storage media may be any available media that can be accessed by a computer. By way of example, and not limitation, such computer-readable media can comprise RAM, ROM, EPROM, EEPROM, Flash, CD, DVD or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), optical disc, digital versatile disc (DVD), floppy disk and Blu-ray disc where disks usually reproduce data magnetically, while discs reproduce data optically with lasers or LEDs. Combinations of the above should also be included within the scope of computer-readable media.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the sprit or scope of the invention. Thus, the present invention is not intended to be limited to the exemplary embodiments shown herein but is to be accorded the widest scope consistent with the principles and novel features disclosed herein.

What I claim is:

1. An apparatus for sound amplification and modification, comprising:

a plurality of sound transducers configured to direct sound in different directions; and a plurality of amplifiers operably coupled with the sound transducers; and an electronic signal processor operably coupled to the amplifiers; and the electronic signal processor configured to receive a sound signal, divide the sound signal into a plurality of sound signals, each of the plurality of sound signals occupying the same frequency band, modulate each divided sound signal with a separate amplitude envelope and couple each modulated sound signal to one or more of the amplifiers; and the electronic signal processor is further configured to modulate the divided sound signals in a manner that causes a sound source to orbit; and the electronic signal processor is further configured to delay at least a first signal of the divided sound signals such that the first sound signal coupled to at least a first transducer of the plurality of sound transducers facing in a first direction has a first delay, and an at least a second sound signal of the divided sound signals coupled to at least a second transducer facing in a second direction has a second delay; and the first delay and the second delay are different; and the first direction and the second direction are different; and the at least two delays are varied in a manner that causes a celeste effect.

2. The apparatus for sound amplification and modification of claim 1, wherein the delay of the at least one divided sound signal is varied in synchronism with the amplitude envelope or not in synchronism with the amplitude envelope.

3. The apparatus for sound amplification and modification of claim 1, wherein the delays are varied periodically or aperiodically.

4. The apparatus for sound amplification and modification of claim 1, wherein the delays are less than 5 milliseconds.

5. The apparatus for sound amplification and modification of claim 1, wherein the delays comprise a delay envelope and the delay envelope is asymmetric.

6. The apparatus for sound amplification and modification of claim 1, wherein the apparatus is further configured to delay the divided sound signals in a manner that causes there to be a plurality of celeste effects.

7. The apparatus for sound amplification and modification of claim 1, wherein the apparatus is further configured to have a player control over at least one of a parameter of speed of celeste effect, a parameter of depth of celeste effect, a parameter of acceleration between speeds of celeste effect, a parameter of deceleration between speeds of celeste effect or a parameter of disabling the celeste effect.

8. The apparatus for sound amplification and modification of claim 1, wherein the apparatus is further configured to have remote control by an external device over at least one of a parameter of speed of celeste effect, a parameter of depth of celeste effect, a parameter of acceleration between speeds of celeste effect, a parameter of deceleration between speeds of celeste effect or a parameter of disabling the celeste effect.

9. The apparatus for sound amplification and modification of claim 1, wherein the apparatus is made up of a plurality of connected physical devices.

10. The apparatus for sound amplification and modification of claim 1, wherein the electronic signal processor function or part of the electronic signal processor function is performed by a separate computing device.

11. The apparatus for sound amplification and modification of claim 1, wherein the number of directions of sound transducers is at least two.

12. The apparatus for sound amplification and modification of claim 1, wherein the number of directions of sound transducers is at least three.

13. The apparatus for sound amplification and modification of claim 1, wherein the number of directions of sound transducers is at least four.

14. A method for sound amplification and modification, the method comprising:

receiving a sound signal by an electronic signal processor, the electronic signal processor configured for dividing the sound signal into a plurality of sound signals, each of the plurality of sound signals occupying the same frequency band, modulating each of the divided sound signals with a separate amplitude envelope; and the electronic signal processor is further configured for delaying with a first delay at least a first sound signal of the divided sound signals and coupling the first sound signal to at least a first transducer of the plurality of sound transducers facing in a first direction, and delaying with a second delay an at least a second sound signal of the divided sound signals coupled to at least a second transducer facing in a second direction; and the first delay and the second delay are different; and the first direction and the second direction are different; and the at least two delays are varied; and amplifying each of the divided sound signals and directing sound in a plurality of different directions in a manner that causes a sound source to orbit and in a manner that causes a celeste effect.

15. A non-transitory computer program product for sound amplification and modification, comprising:

a non-transitory computer-readable medium comprising:

code for controlling receiving a sound signal by an electronic signal processor, dividing the sound signal into a plurality of signals, each of the plurality of sound signals occupying the same frequency band, modulating each of the divided sound signals with a separate amplitude envelope; and code for delaying with a first delay at least a first sound signal of the divided sound signals and coupling the first sound signal to at least a first transducer of the plurality of sound transducers facing in a first direction, and delaying with a second delay an at least a second sound signal of the divided sound signals coupled to at least a second transducer facing in a second direction; and the first delay and the second delay are different; and the first direction and the second direction are different; and the at least two delays are varied; and code for controlling amplifying the signals by a plurality of amplifiers; and code for controlling directing sound in different directions by a plurality of sound transducers; and code for modulating the divided signals in a manner that causes a sound source to orbit and for delaying at least two of the divided sound signals in a manner that causes a celeste effect.

* * * * *